US008389835B2

(12) United States Patent
Findley et al.

(10) Patent No.: US 8,389,835 B2
(45) Date of Patent: Mar. 5, 2013

(54) SOUND SYSTEM IN A STRINGED MUSICAL INSTRUMENT

(75) Inventors: Sean Findley, Gilroy, CA (US); Lynette Findley, Gilroy, CA (US)

(73) Assignee: Sean J. Findley, Gilroy, CA (US)

( * ) Notice: Subject to any disclaimer, the term of this patent is extended or adjusted under 35 U.S.C. 154(b) by 211 days.

(21) Appl. No.: 13/020,667

(22) Filed: Feb. 3, 2011

(65) Prior Publication Data

US 2011/0192273 A1 Aug. 11, 2011

Related U.S. Application Data

(60) Provisional application No. 61/337,637, filed on Feb. 5, 2010.

(51) Int. Cl.
*G10D 3/02* (2006.01)

(52) U.S. Cl. ..... 84/267; 84/291; 84/294; 84/743

(58) Field of Classification Search ..... 84/267
See application file for complete search history.

(56) References Cited

U.S. PATENT DOCUMENTS

| | | | | |
|---|---|---|---|---|
| 3,550,495 | A | 12/1970 | Shotmeyer | |
| 3,821,475 | A | 7/1974 | McKechnie | |
| 4,464,967 | A | 8/1984 | Trimborn | |
| 5,056,400 | A | 10/1991 | Wachi | |
| D325,742 | S | 4/1992 | Phillips | |
| 5,854,435 | A | 12/1998 | Kim | |
| 5,929,362 | A | 7/1999 | Oteyza | |
| 6,191,350 | B1 * | 2/2001 | Okulov et al. | 84/646 |
| 6,605,765 | B1 | 8/2003 | Johnson | |
| 7,002,070 | B2 * | 2/2006 | Katz | 84/718 |
| 2007/0180975 | A1 * | 8/2007 | Paris et al. | 84/291 |
| 2008/0184864 | A1 | 8/2008 | Holt | |

* cited by examiner

*Primary Examiner* — Christopher Uhlir

(57) ABSTRACT

A sound system producing characteristic sounds from an acoustic instrument is provided. The sound system may include a stringed musical instrument and an electronic audio subsystem. The stringed musical instrument may include a neck extending away from a body toward a head. A plurality of strings may be stretched from a bridge on the body to the head at a terminal end of the neck. The bridge may be coupled to a soundboard and operable for connecting the plurality of strings to the body. The electronic audio subsystem may include at least one distributed mode loudspeaker. The distributed mode loudspeaker may be attached to the soundboard of the stringed musical instrument. The distributed mode loudspeaker may induce uniformly distributed vibration modes in the soundboard. A power amplification device may be disposed inside the body of the stringed musical instrument to provide power to the distributed mode loudspeaker.

10 Claims, 3 Drawing Sheets

SOUND SYSTEM IN A STRINGED MUSICAL INSTRUMENT

CROSS-REFERENCE TO RELATED APPLICATION

The present application claims the benefit under 35 U.S.C. §119(e) of U.S. Provisional Application No. 61/337,637 entitled "A method to produce characteristic sound from acoustic instruments", filed Feb. 5, 2010, which is incorporated herein by reference.

BACKGROUND OF THE INVENTION

The present invention generally relates to an electrical sound system, and more particularly, to a sound system in a musical instrument.

Stringed musical instruments capable of converting string vibrational energy to acoustic form have been used for centuries for entertainment. Guitars capable of converting string vibrational energy to acoustic and electrical forms have provided entertainment for decades.

The performance of an acoustic guitar and other stringed instruments, for example, depend on a resonant chamber behind the strings to amplify and to provide depth and warmth to the faint sounds produced by the strings. In other words, the rich sounds of the various types of traditional guitars are due to the various types of construction of the body of the guitar.

An electrical guitar, for example, on the other hand, produces a different selection of sounds and timbres, because such a guitar has the ability to electrically/magnetically pickup and amplify the sounds made by their strings. The electrical guitar can produce sounds through an externally plugged in speaker or amplifier with greater amplitude and may provide for easy electronic adjustment. However, an electric guitar may not resonate like an acoustic guitar and may not produce the warm and rich sounds of an acoustic guitar.

As can be seen, there may be a need for a sound system that may produce amplified resonant sounds from an acoustic stringed instrument.

SUMMARY OF THE INVENTION

In one aspect of the present invention, a sound system, comprises a stringed musical instrument, the stringed musical instrument having a neck extending away from a body toward a head, and a plurality of strings, each stretched from a bridge on the body to the head at a terminal end of the neck, the bridge being coupled to a soundboard and operable for connecting the plurality of strings to the body; at least one loudspeaker, the loudspeaker being disposed in the soundboard of the stringed musical instrument; and a power amplification device being disposed inside the body of the stringed musical instrument configured to receive sound signals from a line-level sound source and to provide amplified sound signals to a distributed mode loudspeaker, wherein the distributed mode loudspeaker is adapted to induce uniformly distributed vibration modes in the soundboard.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. Broadly, embodiments of the present invention generally provide for a sound system capable of producing characteristic sounds from acoustic instruments.

The sound system may include an acoustic guitar or another acoustic instrument. A distributed mode loudspeaker or other vibratory device capable of providing mechanical excitation may be attached directly to a resonating surface of the acoustic guitar. A high fidelity power amplifier may be disposed inside the acoustic guitar so that the acoustic guitar may produce characteristic acoustic guitar sounds from recorded or live sound sources. The acoustic guitar may become a "hybrid" between a real music instrument and a high fidelity sound system. The acoustic guitar may be played as a music instrument concurrently with sounds produced by other external sound systems.

Figure 1:
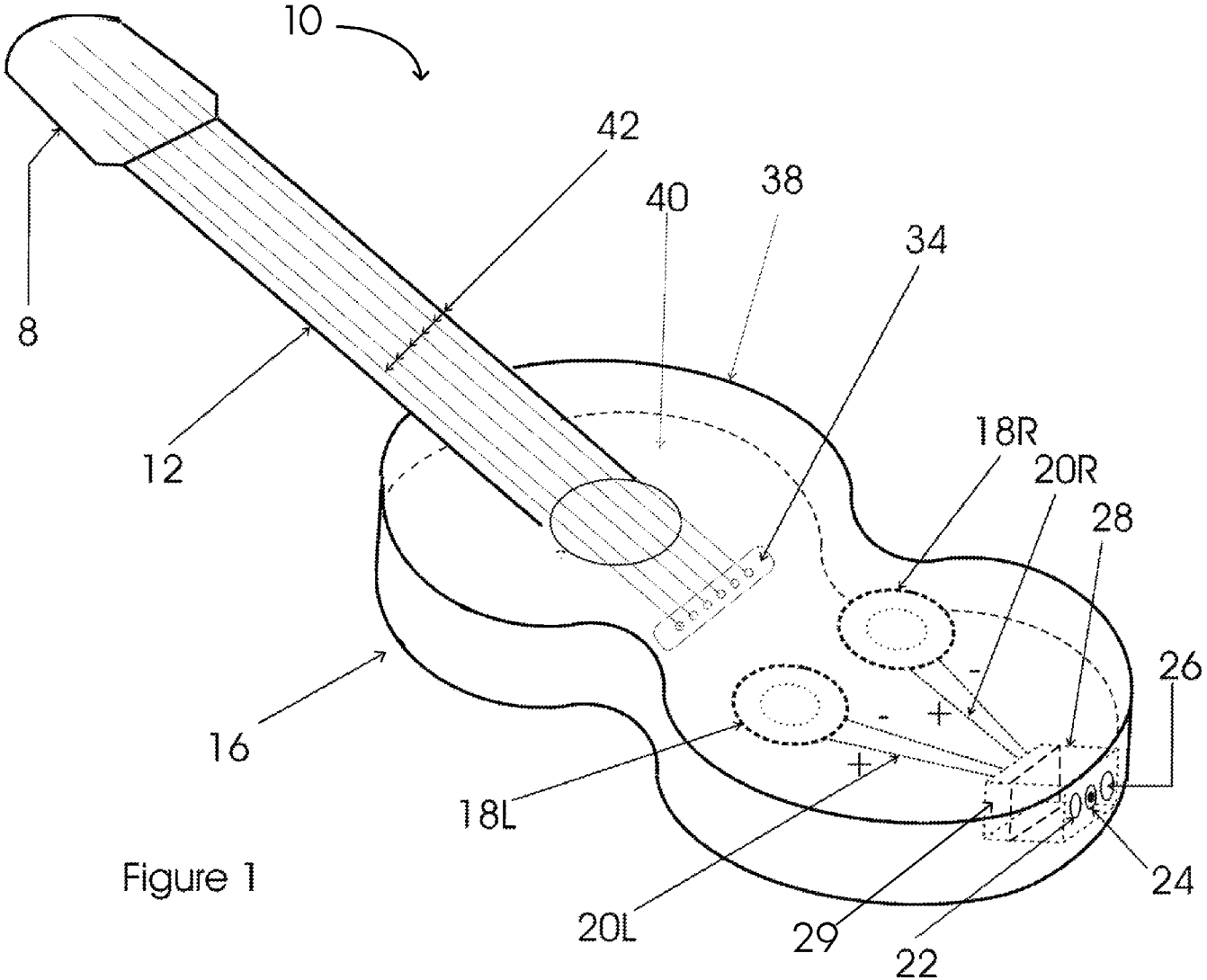
FIG. 1 is a perspective view of a sound system according to an embodiment of the present invention.
Figure 2:
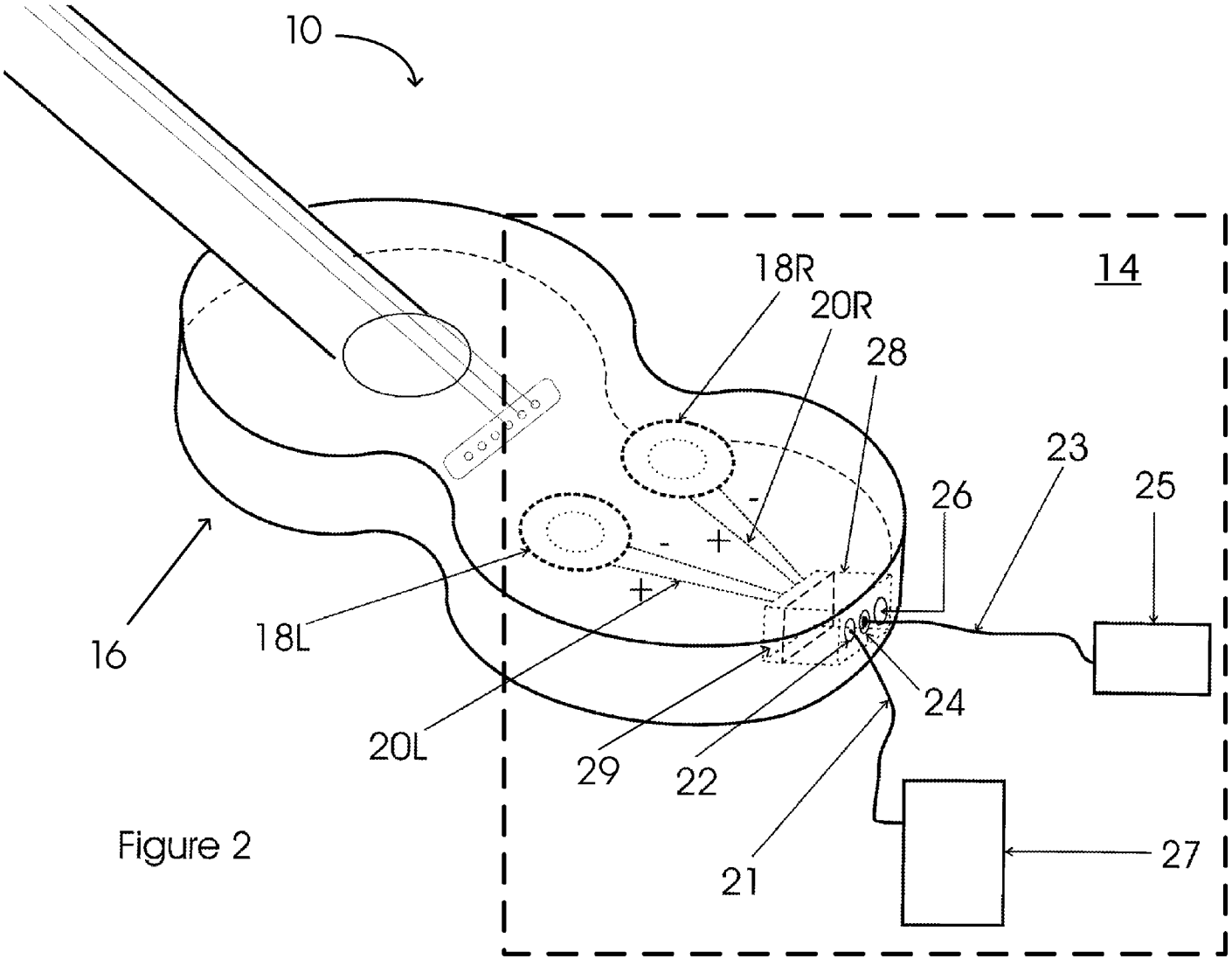
FIG. 2 is a perspective view of an electronic audio subsystem of the sound system of FIG. 1.

Referring now to FIGS. 1 and 2, different views of the sound system 10 are shown according to an exemplary embodiment of the present invention. The sound system 10 may include an acoustic guitar 16 and an electronic audio subsystem 14. The acoustic guitar 16 may include a neck 12 extending away from a body 40 toward a head 8, and a plurality of strings 42. Each of the strings may be stretched from a bridge 34 on the body 40 to the head 8 at a terminal end of the neck 12. The bridge 34 may be coupled to a soundboard 38 and may be operable to connect the plurality of strings 42 to the body 40.

The electronic audio subsystem 14 may include two distributed-mode loudspeakers 18L and 18R and a power amplification device 28. The distributed-mode loudspeakers 18L and 18R may be disposed inside the acoustic guitar 16. The distributed-mode loudspeakers 18L and 18R may be directly attached to the soundboard 38. Adhesive may be used for the attachment making it unnecessary to modify the construction of the acoustic guitar 16. The distributed-mode loudspeakers 18L and 18R may be electrically connected to the power amplification device 28. The power amplification device 28 may be configured to receive sound signals from an audio signal source 27 and electrically amplify those sound signals into electrical signals. The distributed-mode loudspeakers 18L and 18R may convert the electrical signals received from the amplifier 28 into force or vibrations to create organized bending resonances in the soundboard 38. The bending resonances may produce the characteristic sounds of the acoustic guitar.

A line-level stereo audio input signal may be connected from the audio signal source 27. The audio signal source 27 may be a line-level source, for example, a compact disk player connected to the acoustic guitar 16 by an audio cable 21 via an input connector 22. The power amplification device 28 may be for example, a digital implementation of a Class D power amplifier and may be disposed inside of the body 40 of the acoustic guitar 16. The power amplification device 28 may deliver electrical signals to the distributed-mode loudspeakers 18L and 18R through wire connections 20L and 20R respectively.

The power amplification device 28 may operate on direct current (DC) electricity provided by an external power source 25. The external power source 25 may be connected to the power amplification device 28 through a connector 24 via an electrical cable 23. The output level of power amplification device 28 may be controlled by a volume control knob 26. In an alternative embodiment, the sound system 10 may be powered by batteries placed inside the body 40 of the acoustic guitar 16, making the sound system 10 portable.

Figure 3:
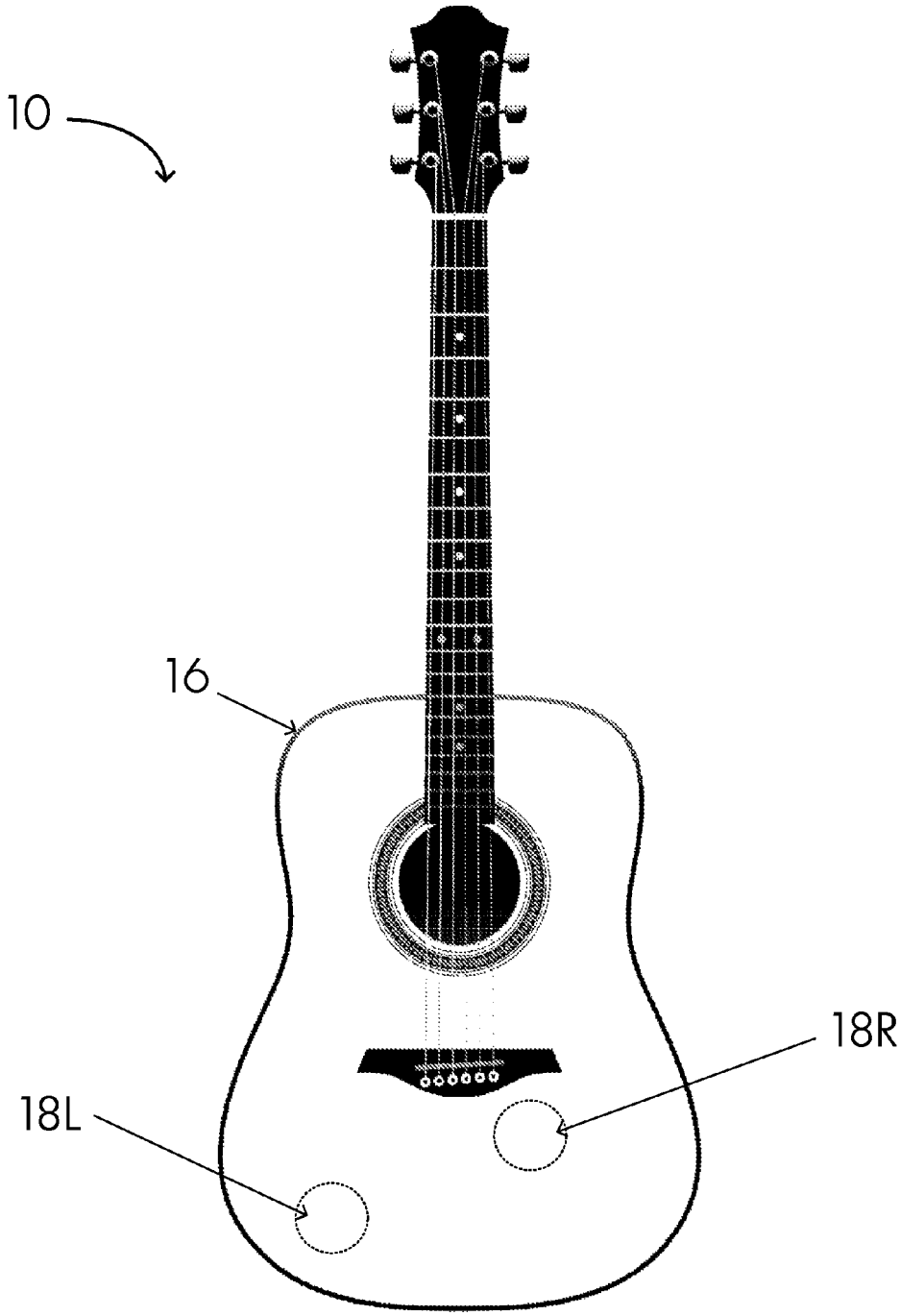
FIG. 3 is a front view according to an alternate exemplary embodiment of a sound system, illustrating exemplary locations of loudspeakers.

Referring now to FIG. 3, a front view of an alternate embodiment of the sound system 10 is shown. FIG. 3 illustrates an exemplary location of the distributed mode loudspeakers 18L and 18R. One of the distributed mode loudspeakers, for example 18R, may be placed in close proximity to bridge 34. The loudspeaker 18R may be offset closer toward an invisible centerline that extends from the head down to a base of the guitar than the loudspeaker 18L. The loudspeaker 18L may be positioned offset away from the invisible centerline toward the left side of the guitar and toward the base of the guitar 16 and farther away from the bridge than the loudspeaker 18R. It should be noted, the placement of the distributed mode loudspeakers 18L and 18R in reference to the bridge 34 and the bottom of the guitar 16 are interchangeable.

The sound system 10 may respond to notes or chords played by a musician to produce accompaniment. The sound system 10 may be connected to a live audio signal produced by another guitar to produce symphonic sounds from live music.

In another embodiment of the sound system 10, an embedded computer 29 may be integrated within the body 40 of the acoustic guitar 16. The embedded computer 29 may produce audio signals through either a digital to analog converter or a direct digital path and the produced audio signals may be fed to the power amplification device 28. The acoustic guitar 16 may reproduce tones and music from the embedded computer without being connected to the audio signal source 27.

The sound system 10 with the embedded computer 29 may provide tuning reference tones for each of the strings 42. The acoustic guitar 16 may produce the correctly pitched tone for each of the strings 42 for a given tuning arrangement. This may allow a user to play the strings 42 on the acoustic guitar 16 and tune them to the reference tones. The acoustic guitar 16 may also produce metronomic sounds to help a learner with the tempo of a music piece. The sound system 10 with the embedded computer 29 may be used to train a novice musician by producing music practice sounds for the development of timing and rhythm.

It should be understood, of course, that the foregoing relates to exemplary embodiments of the invention and that modifications may be made without departing from the spirit and scope of the invention as set forth in the following claims.

What is claimed is:

1. A sound system, comprising:

a stringed musical instrument, the stringed musical instrument having a neck extending away from a body toward a head, and a plurality of strings, each stretched from a bridge on the body to the head at a terminal end of the neck, the bridge being coupled to a soundboard and operable for connecting the plurality of strings to the body;

at least one loudspeaker, the loudspeaker being disposed in the soundboard of the stringed musical instrument; and a power amplification device connected to the loudspeaker and being disposed inside the body of the stringed musical instrument configured to receive sound signals from a line-level sound source and to provide amplified sound signals to the loudspeaker, wherein the loudspeaker is adapted to induce uniformly distributed vibration modes in the soundboard.

2. The sound system of claim 1, wherein the stringed musical instrument is an acoustic guitar.

3. The sound system of claim 1, wherein the loudspeaker is a distributed mode loudspeaker.

4. The sound system of claim 3, wherein the distributed mode loudspeaker is directly attached to the soundboard.

5. The sound system of claim 1 wherein the sound system includes a first and a second loudspeaker and wherein the first loudspeaker is positioned closer to the bridge than the second loudspeaker.

6. The sound system of claim 5, wherein a first and second loudspeaker are positioned in the soundboard offset laterally from one another along a centerline extending from the head to a base of the musical instrument.

7. The sound system of claim 5, wherein the loudspeakers are positioned in the sound board relative to the bridge to correspond to the natural resonant model output of the sound board.

8. The sound system of claim 1, wherein the power amplification device is a digital implementation of a Class D power amplifier.

9. The sound system of claim 1 further comprising an embedded computer disposed inside of the stringed musical instrument to serve as an alternate sound source to the power amplification device.

10. The sound system of claim 9, wherein the embedded computer is configured to provide a tuning reference tone for a string and to produce metronomic sounds.

* * * * *